United States Patent [19]

Nomura et al.

[11] Patent Number: 4,498,440

[45] Date of Patent: Feb. 12, 1985

[54] MIXTURE CONTROL APPARATUS FOR CARBURETOR

[75] Inventors: Toshio Nomura; Yasuhiro Imai; Tomio Aoi; Tetsuo Nakajima; Hiroshi Irino, all of Saitama, Japan

[73] Assignee: Honda Giken Kogyo Kabushiki Kaisha, Tokyo, Japan

[21] Appl. No.: 595,867

[22] Filed: Apr. 2, 1984

[51] Int. Cl.[3] ..... F02M 7/24

[52] U.S. Cl. ..... 123/438; 123/437; 123/489

[58] Field of Search ..... 123/438, 437, 489, 585, 123/339

[56] References Cited

U.S. PATENT DOCUMENTS 4,250,855 2/1981 Kohama et al. ..... 123/438
4,295,451 10/1981 Long ..... 123/438
4,306,523 12/1981 Takeda ..... 123/438
4,417,553 11/1983 Ohkawa et al. ..... 123/585
4,442,818 4/1984 Kashiwaya et al. ..... 123/438

*Primary Examiner*—Raymond A. Nelli
*Attorney, Agent, or Firm*—Pollock, Vande Sande and Priddy

[57] ABSTRACT

A mixture control apparatus for a carburetor which precludes otherwise possible occurrence of fluctuation in the opening angle of the throttle valve even when the engine operation happens to fall near the boundary between the cold state and the hot state. The electric motor for driving the throttle valve is prevented from moving to the side of reverse rotation thereof from the side of normal rotation thereof past a home position after said engine has been changed to its hot state and unless a stop of said engine is detected.

1 Claim, 8 Drawing Figures

MIXTURE CONTROL APPARATUS FOR CARBURETOR

BACKGROUND OF THE INVENTION

1. Field of the Invention

This invention relates to a mixture control apparatus for a carburetor, and more particularly to a mixture control apparatus for use in a carburetor of the type having a choke valve on the upstream side and a throttle valve on the downstream side respectively in an intake barrel relative to a venturi section admitting an opening end of a main fuel nozzle, which mixture control apparatus is adapted to control the opening angle of the aforementioned choke valve and throttle valve by means of two cams fixed on one output shaft of an electric motor or on one output shaft of a speed reducer of the electric motor.

More specifically, this invention relates to a mixture control apparatus for a carburetor, constructed so that the movement of an electric motor from the side of reverse rotation thereof past a home position to the side of normal rotation thereof is executed based on the logical multiplication of at least the three conditions:

(1) that the engine temperature should exceed the boundary temperature between the cold state and the hot state, (2) that the revolution number of the engine should exceed a preset value, and (3) that the throttle lever should be mechanically separated from the aforementioned second rotary cam, and, after the engine has been changed to the hot state, the aforementioned electric motor is prevented from moving from the side of normal rotation thereof past the home position to the side of reverse rotation thereof unless a stop of the engine is detected.

2. Description of the Prior Art

It is known to provide a mixture control apparatus for a carburetor comprising a choke valve disposed on the upstream side and a throttle valve on the downstream side respectively in an air inlet relative to a venturi section admitting an opening end of a main fuel nozzle, first rotary cam means interlocked with said choke valve and adapted to operate said choke valve from the totally opened position to the totally closed position thereof, second rotary cam means interlocked with said throttle valve and adapted to operate said throttle valve to a prescribed degree of opening for fast idling, and an electric motor for driving said first and second rotary cam means and determining the rotational positions thereof according to the operating condition of an internal combustion engine, which mixture control apparatus is characterized in that said electric motor is adapted to be rotated in a normal direction and in a reverse direction from a home position thereof as the boundary, that said first and second cam means have the shapes thereof selected so that when said electric motor is rotated in the normal direction from said home position, said choke valve will be retained at a substantially fully opened position and said throttle valve will have the degree of opening thereof increased and, when said electric motor is rotated in the reverse direction from said home position, said choke valve will have the degree of opening thereof decreased and said throttle valve will have the degree of opening thereof increased. The construction of the carburetor part and the construction and operation of an electrical control circuit incorporated therein are described in detail in the specification of Japanese Patent Application SHO 56(1981)-177996, for example.

SUMMARY OF THE INVENTION

An object of this invention is to provide a mixture control apparatus for a carburetor in an internal combustion engine, which enables the degrees of opening of the choke valve and the throttle valve of the conventional carburetor to be controlled in accordance with the state of the engine.

DETAILED DESCRIPTION OF THE PREFERRED EMBODIMENT

Now, the present invention will be described below with reference to the accompanying drawings.

Figures 1, 1A:
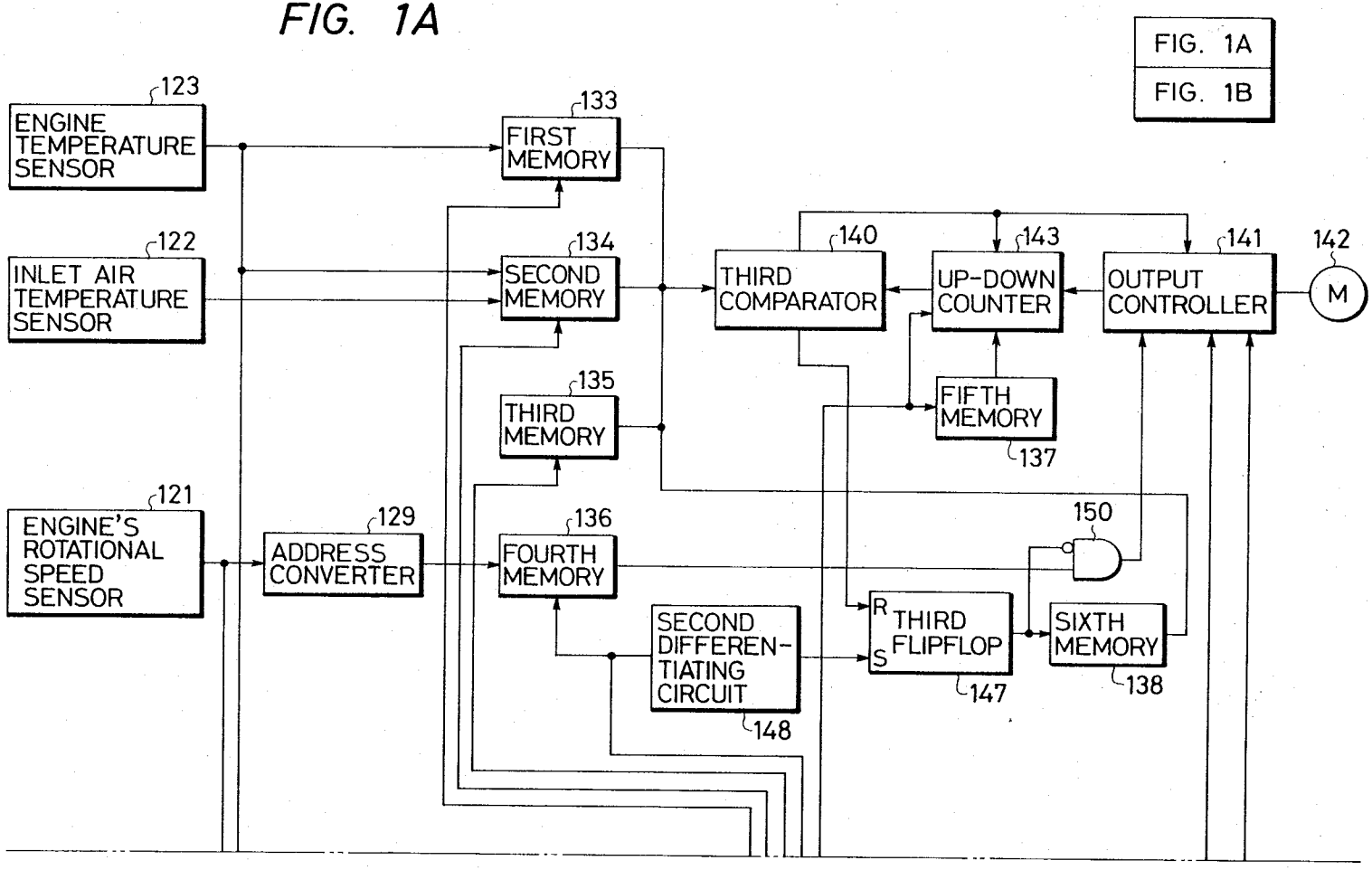
FIG. 1 shows how to incorporate FIGS. 1A and 1B.
FIG. 1A and FIG. 1B show a block diagram illustrating one typical conventional mixture control apparatus for the carburetor.
Figure 1B:
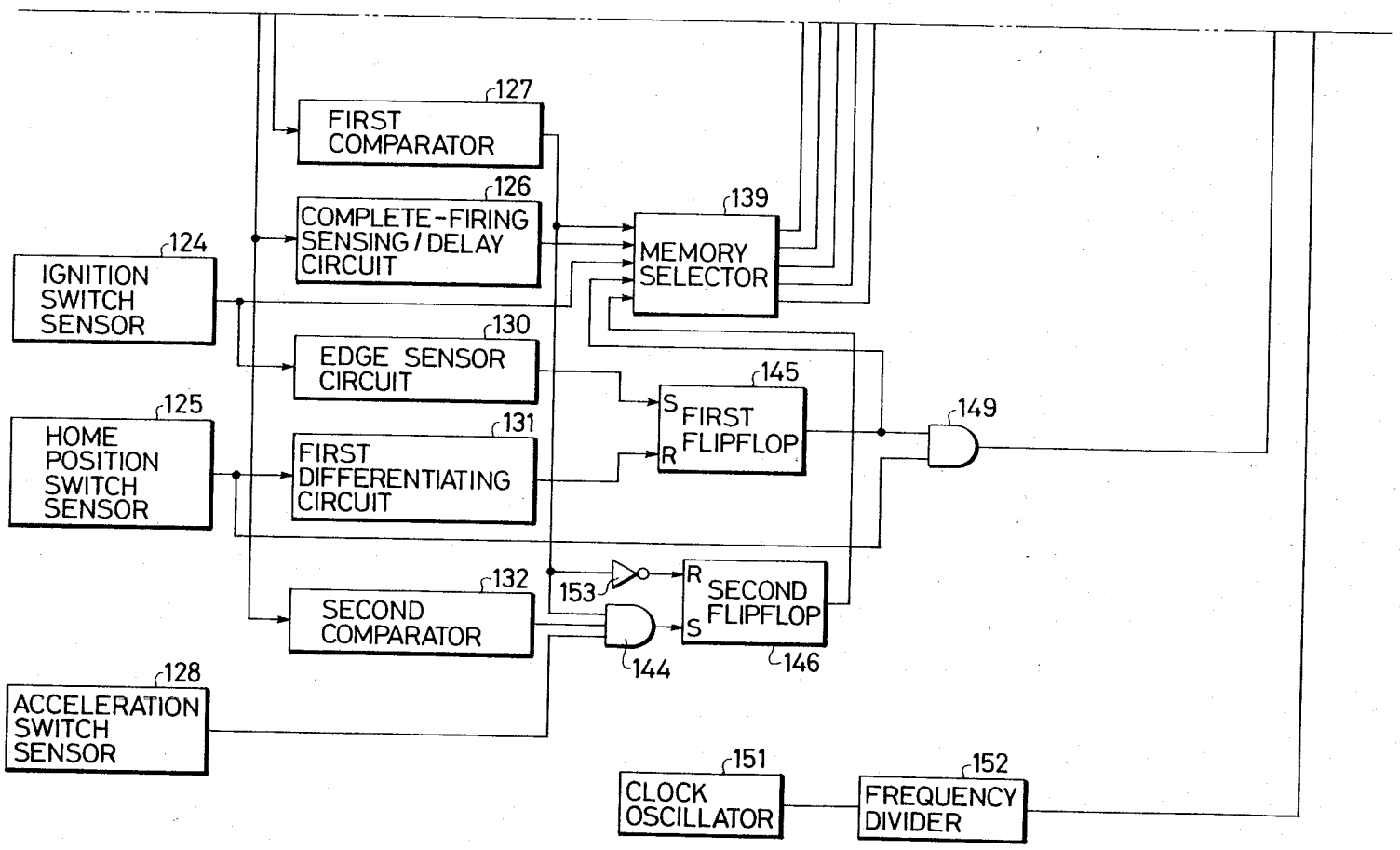
Figures 2, 2A:
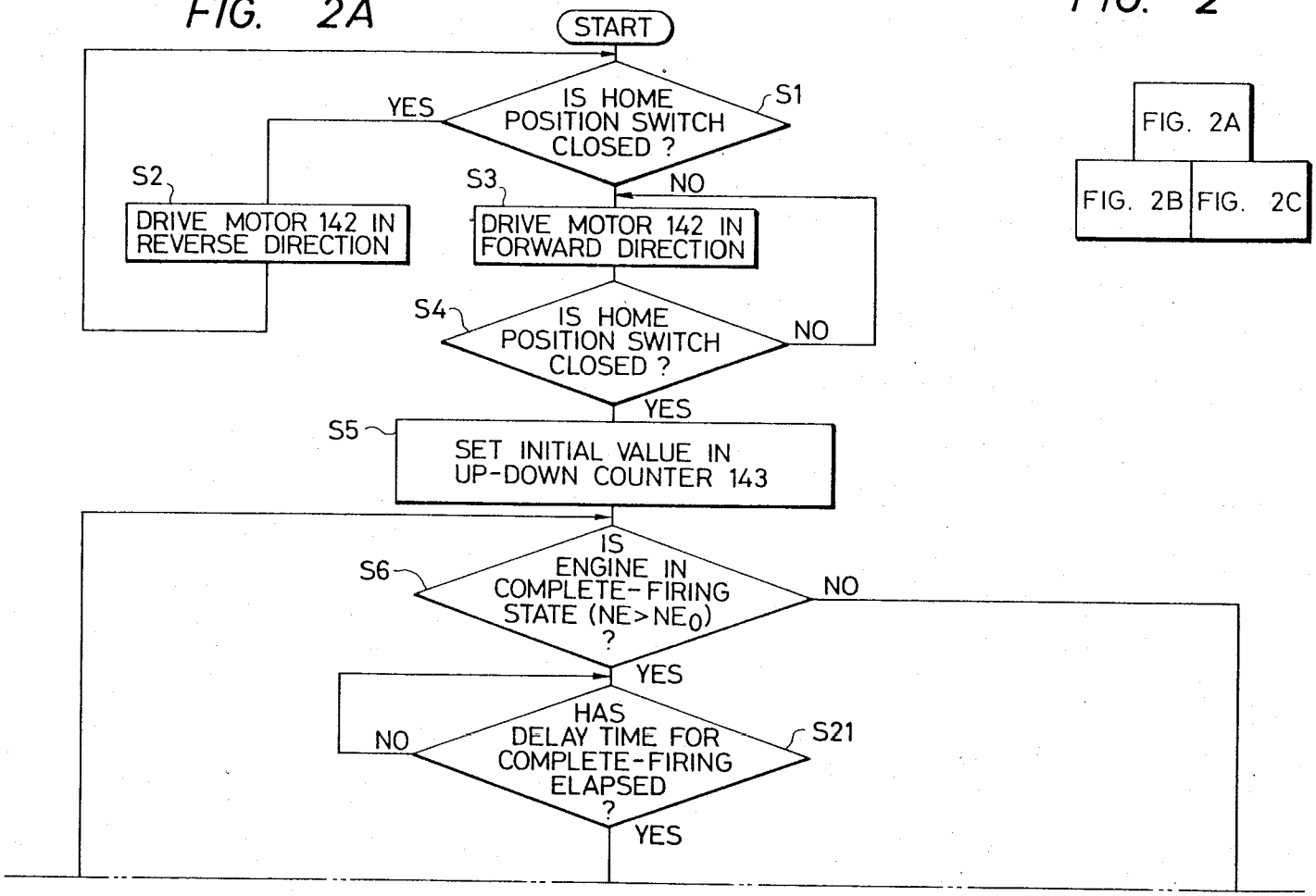
FIG. 2 shows how to incorporate FIGS. 2A, 2B and 2C.
FIGS. 2A, 2B and 2C show a flow chart for illustrating a typical operation of the apparatus shown in FIG. 1A and FIG. 1B.
Figure 2B:
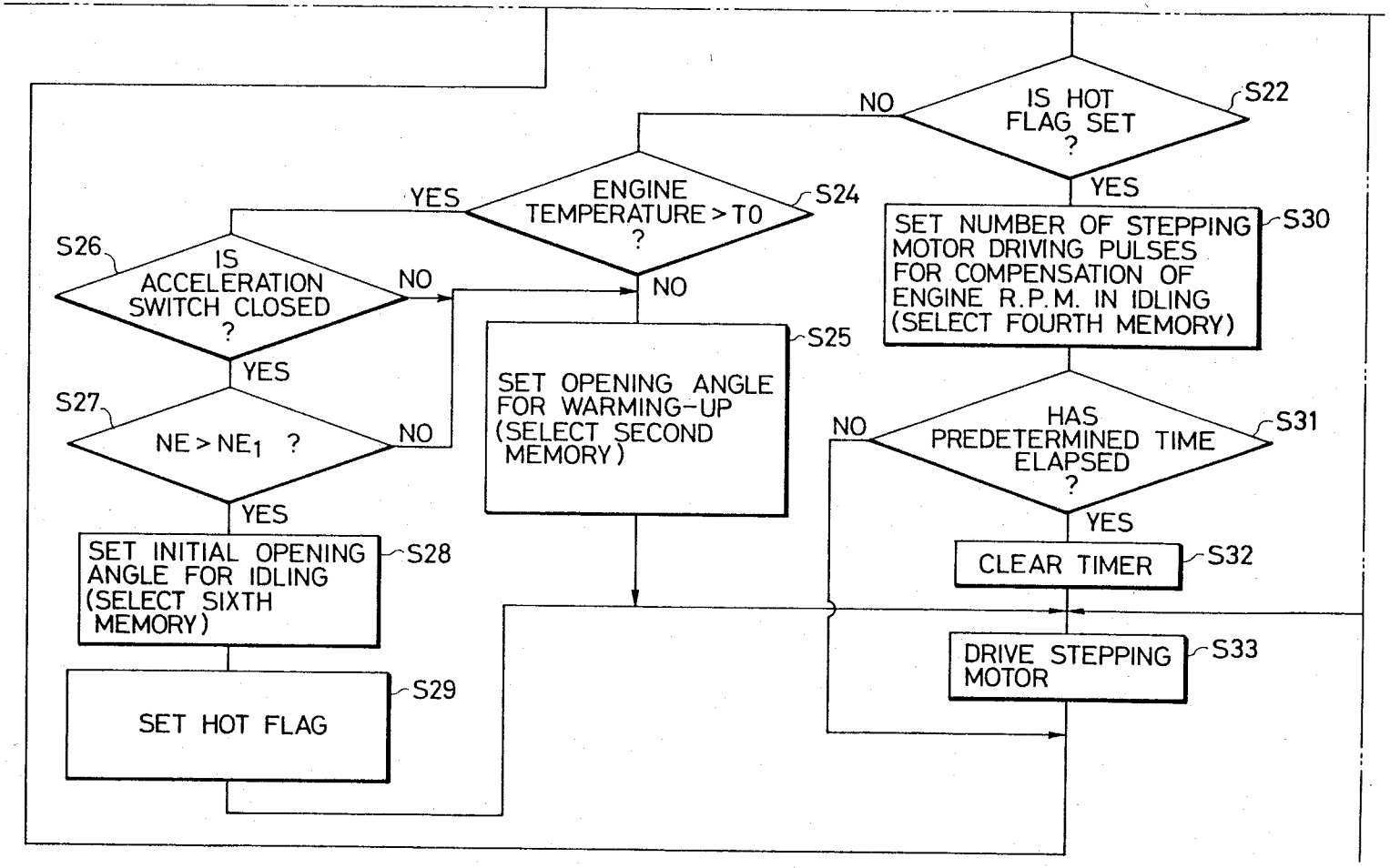
Figure 2C:
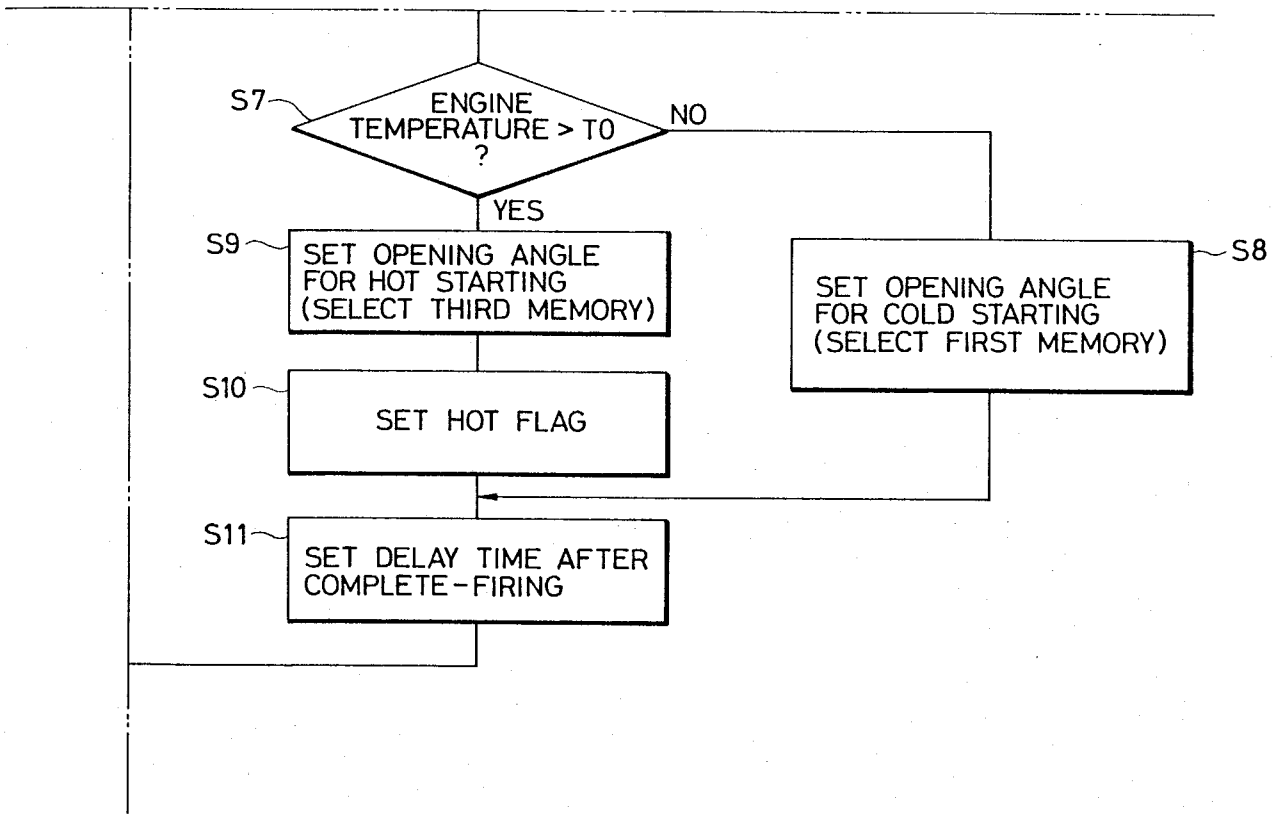

FIG. 1A and FIG. 1B show a block diagram of an electrical control circuit in a mixture control apparatus for use in the carburetor of this invention and FIGS. 2A, 2B and 2C show a flow chart for illustrating the operation of the electrical control circuit. The operation of the carburetor of this invention will be outlined below with reference to FIG. 1, FIGS. 1A and 1B, FIG. 2, FIGS. 2A, 2B and 2C.

When an ignition switch (not shown) is turned on to start an engine, an ignition switch sensor 124 detects this fact and an edge sensor circuit 130 issues its output to set a first flipflop 145.

Consequently, a first AND gate 149 is opened. The fact that the first flipflop 145 has been set causes a memory selector 139 to select a fifth memory 137.

At this time, in Step S1 illustrated in FIG. 2, it is judged whether a home position switch (not shown) is in an opened state or a closed state.

When the home position switch happens to be in a closed state, for example, a home position switch sensor 125 issues an output "1 ". This signal is forwarded via the first AND gate 149 and injected into an output controller 141. In response to this input, the aforementioned output controller 141 issues a pulse for causing a stepping motor 142 to rotate in the reverse direction (Step S2 in FIG. 2).

As the stepping motor 142 thus rotated in the reverse direction passes a predetermined home position, the home position switch is opened.

As the result, the output of the home position switch sensor 125 is changed to "0" to close the first AND gate 149. The output controller 141 is consequently caused to issue an output for starting the stepping motor 142 in the normal direction (Step S3 in FIG. 2).

Output pulses of a clock oscillator 151 are divided by a frequency divider 152 to be supplied to the output controller 141 as driving pulses for the stepping motor 142.

This rotation of the stepping motor 142 in the normal direction results in detection of the time at which the home position switch is shifted from the opened state to the closed state (Step S4 in FIG. 2). In the circuit of FIG. 1, this change is sensed by a first differentiating circuit 131. The resulting output from this circuit 131 resets the first flipflop 145 and closes the first AND gate 149.

When the judgment made in Step S1 fails to find the home position switch in its closed state, the output from the first AND gate 149 is "0" and the stepping motor 142 is consequently rotated in the normal direction. When this motor 142 thus rotated in the normal direction reaches its home position, the aforementioned home position switch is shifted from the opened state to the closed state to cause the operation described above.

In this while, the preset value (for initial setting) of the fifth memory 137 is set in an up-down (U/D) counter 143 at the same time that the first flipflop 145 is reset by the output from the first differentiating circuit 131.

In the manner described above, the initialization of the present apparatus is completed. This means that the home position of the stepping motor 142 is brought into exact agreement with the preset value (initial value) of the U/D counter 143 (Step S5 in FIG. 2). At the same time, a hot flag is set in the step S5 in FIG. 2.

When this initialization is completed, an engine's rotational speed sensor 121 issues an output to a complete-firing sensing/delay circuit 126 so as to confirm that the state of complete-firing has not yet been assumed, namely the fact that the engine's rotational speed NE is still smaller than the preset value $NE_0$ (Step S6 in FIG. 2).

Further, the output from an engine temperature sensor 123 is compared with a fixed value T0 in a first comparator 127 to form a judgment as to whether the engine is in a cold state or in a hot state (Step S7 in FIG. 2).

When the engine is in the cold state and its temperature is lower than the fixed value T0 of the first comparator 127, the output from the first comparator 127 is turned to "0" to reset a second flipflop 146. In response to this resetting of the second flipflop 146, the memory selector 139 selects a first memory 133 for cold starting (Step S8 in FIG. 2).

Since the first memory 133 keeps in storage the data on the rotational position of the stepping motor 142 corresponding to the engine temperature, it feeds out the optimum data relative to the engine temperature as it exists at that moment. The output thus issued is forwarded to a third comparator 140.

The third comparator 140 effects comparison of the data from the first memory with the value of count taken by the U/D (up-down) counter 143 and issues an output corresponding to the difference between the two values, respectively as a normal-reverse signal and an up-down signal to the output controller 141 and the U/D counter 143.

Consequently, the stepping motor 142 is rotated to a position which is indicated by the data read out of the first memory 133.

As the result, the cam plates (not shown) fixed to the output shaft of the aforementioned stepping motor 142 are proportionately rotated. A choke valve and a throttle valve (neither shown) are consequently moved by the rotation of their respective cams and set at the degrees of opening optimum for cold starting at the engine temperature as it exists at that moment (Steps S8→S11→S33 in FIG. 2).

Figure 3:
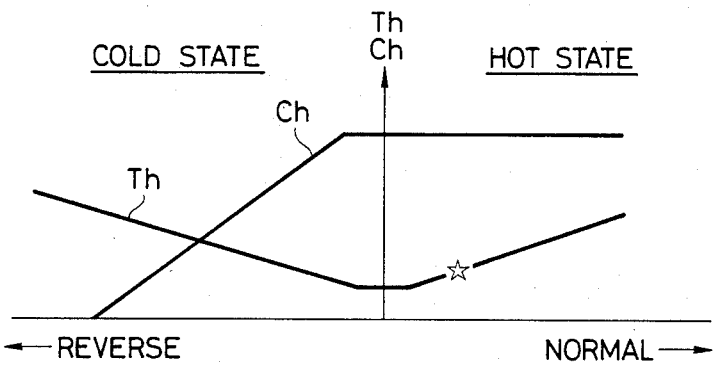
FIG. 3 is a graph showing the relation between the rotational position of a stepping motor and the degrees of opening of a choke valve and a throttle valve.

A typical relation between the rotational position of the stepping motor 142 and the degrees of opening of the choke valve and the throttle valve is shown in FIG. 3. In the diagram, the horizontal axis represents the scale for the rotational position of the stepping motor 142 and the vertical axis represents the scale for the degree of opening Th of the throttle valve and the degree of opening Ch of the choke valve.

As the stepping motor 142 is rotated in the reverse direction with its home position as the boundary, it moves the valves and sets them at the degrees of opening optimum for the cold state. As it is rotated in the normal direction, it moves and sets the valves at the degrees of opening optimum for the hot state.

When the judgment in Step S7 of the diagram of FIG. 2 finds the engine temperature to be higher than the set value T0 of the first comparator 127, the engine is in the hot state.

In that case, the output from the first comparator 127 is "1" which causes the memory selector 139 to select the third memory 135 for hot starting, with the result that a hot flag is set up (Steps S9→S10 in FIG. 2).

The third memory 135 keeps in storage the data on the rotational position of the stepping motor 142 for hot starting. It issues said rotational position data as its output to the third comparator 140. Consequently, in the same way as described above, the stepping motor 142 is rotated to a position which is indicated by the data read out of the third memory 135 (Steps S9→S10→S11→S33 in FIG. 2).

When a starter switch (not shown) in status quo is closed, the engine is started and its rotational speed is increased.

The rotational speed of the engine is detected by the engine's rotational speed sensor 121 and, in the complete-firing sensing/delay circuit 126, it is judged whether or not the engine has assumed the complete firing state. As indicated in Step S6 of the diagram of FIG. 2, it is judged whether or not the engine's rotational speed NE is larger than the detected value $NE_0$ of the stall.

The processing is repeated through the loop of Steps S6→S7→S8→S11→S33 or the loop of Steps S6→S7→S9 →S10→S11→S33 until the complete firing state is assumed.

When the complete firing state is assumed, the judgment in Step S6 gives an affirmative result and, consequently, the processing is advanced to Step S21. When the delay time after complete firing has elapsed, the processing moves on to Step S22, there to induce formation of a judgment as to whether the hot flag is set up or not.

When the engine is started while it is in the cold state, since the hot flag is not set, the processing advances to Step S24, there to induce formation of judgment whether the engine temperature has risen above the boundary temperature T0, between the temperatures of the cold and hot states.

When the engine temperature does not exceed the aforementioned boundary temperature T0, the processing proceeds to Step S25, there to select the second memory 134 for warming. This particular operation is caused by the fact that the memory selector 139 selects the second memory 134 on the two conditions that in the apparatus of FIG. 1, the complete-firing sensing-/delay circuit 126 should issue its output and that the output from the first comparator 127 should be "0".

As is clear from FIG. 1, the second memory 134 receives the outputs of the inlet air temperature sensor 122 and the engine temperature sensor 123 and, based on these outputs as parameters, the data on rotational position of the stepping motor 142 are read out of the second memory.

Then in the same manner as described above, the stepping motor 142 is operated according to the data so read out, to effect the control of the degrees of opening of the choke valve and the throttle valve (Step S33 in FIG. 2).

As the engine continues its rotation, the temperature of the engine is gradually raised. When the engine temperature rises to a point where the judgment in Step S24 of FIG. 2 gives an affirmative result, the processing advances to Step S26 and induces formation of a judgment as to whether the acceleration switch is closed or not.

When the judgment does not find the acceleration switch in a closed state, the processing proceeds from Step S25 to Step S33 to repeat the aforementioned operation.

When the acceleration switch is found to be in a closed state, the processing advances to Step S27, there to induce formation of a further judgment as to whether the rotational speed NE of the engine is greater than the prescribed value $NE_1$ or not. When the judgment gives a negative result, the processing similarly advances to Step S25 and Step S33 and executes the cycle for warming.

When the judgments in Steps S26 and S27 both give affirmative results, the processing advances to Step S28. To be specific, the initial value of idling stored in a sixth memory 138 of FIG. 1 is read out, a hot flag is then set up in Step S29, and the rotational position of the stepping motor is controlled in Step S33.

The operation described above is effected in the apparatus of FIG. 1 as follows.

As the engine temperature rises, the output from the engine temperature sensor 123 increases and, consequently, the output from the first comparator 127 is reverted to "1". In the meantime, as the rotational speed of the engine increases, the output from the engine's rotational speed sensor 121 is proportionately increased and, consequently, the output from the second comparator 132 is reverted to "1".

As the result, a second AND gate 144 issues an output "1" to set the second flipflop 146 when the output from an acceleration switch sensor 128 is "1". Consequently, the memory selector 139 selects a fourth memory 136 for compensation of the rotational speed of idling.

An address converter 129 converts the output of engine's rotational speed sensor 121 or engine r.p.m. into an address in the fourth memory 136.

The selective output from the aforementioned memory selector 139 is fed also to a second differentiating circuit 148. In response to the output issued from this circuit 148, a third flipflop 147 is set.

The output from the aforementioned flipflop 147 is inverted and then fed to a third AND gate 150 to close this gate 150. For this reason, the read-out data of the aforementioned fourth memory 136 are not fed to the output controller 141.

In the meantime, by the output from the third flipflop 147, the sixth memory 138 for setting the initial value of idling is actuated and the read-out data of this memory 138 are fed to the third comparator 140. In this manner, the stepping motor 142 is driven to the angle of rotation for setting the initial value of idling which is memorized in the aforementioned sixth memory 138.

When the stepping motor 142 is actually rotated to reach the aforementioned initial value of idling, the third comparator 140 issues an output, which resets the third flipflop 147. As the result, the third AND gate 150 is opened and the data from the fourth memory 136 are allowed to be fed to the output controller 141.

Since the fourth memory 136 keeps in storage, as described above, the data for compensation of the rotational position of the stepping motor 142 with the engine's rotational speed as a parameter, it feeds to the output controller 141 the output indicating either the amount of rotation of the stepping motor or the number of drive pulses required for compensation where the engine's rotational speed deviates from the prescribed rotational speed for idling.

Even when the degrees of opening of the choke valve and the throttle valve are adjusted by the operation of the stepping motor 142, no immediate change in the rotational speed is obtained because of the inertia of the engine, for example. In due consideration of this situation, it is desirable that the following control should be suspended for a certain length of time after a change has been made in the rotational position of the stepping motor.

Step S31 of FIG. 2 is intended to allow time for this suspension of the control. Until the time so prescribed for the suspended control elapses, the processing returns to Step S6 instead of proceeding to execute the compensation of the rotational angle of the stepping motor in Step S33.

In the apparatus of FIG. 1, similar allowance of time can be attained by controlling the operation timing of the output controller 141 and/or the third AND gate 150 with a proper timer or sequencer (not shown).

As the elapse of the prescribed time is sensed in Step S31, the timer for measuring the aforementioned prescribed time is cleared in Step S32 and the processing advances to Step S33. Then, the stepping motor is driven according to the data of the fourth memory 136 which has been read out in Step S30.

In the manner described above, transition from the cold state control to the idle operation is effected.

As is evident from the foregoing description, in the mixture control apparatus for the carburetor according to this invention, the transition from the cold region, past the home position, to the hot region or the idle operation region is carried out while the acceleration switch is on.

The open position of the throttle valve, therefore, is set at the initial value of idling in the hot region instead of being approximated to the lowest value near the home position. This special adaptation removes the possibility that, during the aforementioned transition, the degree of opening of the throttle valve will become so insufficient as to entail excessive decline of the rotational speed or total stop of the engine.

Thus, in the mixture control apparatus for the carburetor of this invention, the rotational frequency of the idling operation can be notably stabilized because the direction and the quantity of the rotation of the stepping motor 142 are directly read out of the relevant memories according to the deviation of the rotational speed of the engine from the prescribed value and the rotational speed during the idling operation is controlled based on the data so read out.

Further, simplification of construction and decrease in cost can be materialized because the control of the degrees of opening of the throttle valve and the choke valve is accomplished by monoaxial driving.

There is another advantage that the warming of the engine can be effected quickly because the electric motor cannot return to the status of cold-stage control after the engine has been changed to the hot state and unless the engine is stopped.

Optionally, the mixture control apparatus for the carburetor according to this invention may be embodied in a form modified as indicated below.

(1) The initial setting of the U/D counter 143 is effected at the time that the home position switch is turned from its closed state to its opened state.

(2) The first memory 133 for cold starting is caused to memorize the degree of opening of the throttle valve by using, as a parameter therefor, at least either of the outputs from the inlet air temperature sensor 122 and the engine temperature sensor 123.

(3) The second memory 134 for warming is caused to memorize the degree of opening of the throttle valve by using, as parameters therefor, at least two of the outputs from the engine's rotational speed sensor 121, the inlet air temperature sensor 122, and the engine temperature sensor 123.

(4) The third memory 135 for hot starting is caused to memorize the degree of opening of the throttle valve by using, as a parameter, at least either of the outputs from the inlet air temperature sensor 122 and the engine temperature sensor 123.

(5) The sixth memory 138 for setting the initial value of idling is caused to memorize the degree of opening of the throttle valve by using, as a parameter therefor, at least either of the outputs from the inlet air temperature sensor 122 and the engine temperature sensor 123.

Also, the aforementioned sixth memory 138 is caused to memorize the degree of opening of the throttle degree of opening by using, as parameters therefor, the rotational position of the stepping motor 142 and the data of the fourth memory 136 immediately before transition to the idle operation.

(6) The detection of the operation of the acceleration switch is replaced by the detection of the fact that the throttle lever is not meshed with the interlocking lever.

(7) The following two conditions may be adopted as the requisites for the transition from the cold region to the hot region.

(A) That the engine temperature should be higher than the prescribed value.

(B) That the ratio of increase of the engine's rotational speed should be higher than the prescribed value.

(8) The stepping motor is prevented from undergoing the phenomenon of hunting near the boundary between the cold state and the hot state of the engine by conferring the characteristic of hysteresis upon the set value (either the boundary temperature between the cold and hot states or the ratio of increase of the engine's rotational speed) for discriminating between the cold state and the hot state of the engine.

What is claimed is:

1. A mixture control apparatus for a carburetor comprising a choke valve disposed on the upstream side and a throttle valve on the downstream side respectively in an air inlet relative to a venturi section admitting an opening end of a main fuel nozzle, first rotary cam means interlocked with said choke valve and adapted to operate said choke valve from the totally opened position to the totally closed position thereof, second rotary cam means interlocked with said throttle valve and adapted to operate said throttle valve to a prescribed degree of opening for fast idling, and an electric motor for driving said first and second rotary cam means and determining the rotational positions thereof according to the operating condition of an internal combustion engine, which mixed control apparatus is characterized in that said electric motor is adapted to be rotated in a normal direction and in a reverse direction from a home position thereof as the boundary, that said first and second cam means have the shapes thereof selected so that when said electric motor is rotated in the normal direction from said home position, said choke valve will be retained at a substantially fully opened position and said throttle valve will have the degree of opening thereof increased and, when said electric motor is rotated in the reverse direction from said home position, said choke valve will have the degree of opening thereof decreased and said throttle valve will have the degree of opening thereof increased, that the transition of said electric motor from the reverse rotation side past the home position to the normal rotation side is effected based on a logical conjunction of at least the three conditions that the engine temperature should exceed a boundary temperature between the cold and hot states, the engine's rotational speed should exceed the prescribed value, and the throttle lever should be mechanically separated from said second rotary cam means, and that the characteristic of hysteresis is conferred upon the switch between the cold and hot states by causing said boundary temperature between the cold and hot states to be switched in accordance with whether the engine is in the cold state or in the hot state, and that said electric motor is provided, with means capable of preventing said electric motor from moving from the side of normal rotation thereof past said home position to the side of reverse rotation thereof after said engine has been changed to its hot state and unless a stop of said engine is detected.

* * * * *